US009488331B2

(12) United States Patent
Sharrah

(10) Patent No.: US 9,488,331 B2
(45) Date of Patent: Nov. 8, 2016

(54) PORTABLE LIGHT WITH SELECTABLE OPTICAL BEAM FORMING ARRANGEMENT

(71) Applicant: Streamlight, Inc., Eagleville, PA (US)

(72) Inventor: Raymond L. Sharrah, Collegeville, PA (US)

(73) Assignee: Streamlight, Inc., Eagleville, PA (US)

( * ) Notice: Subject to any disclaimer, the term of this patent is extended or adjusted under 35 U.S.C. 154(b) by 39 days.

(21) Appl. No.: 14/684,699

(22) Filed: Apr. 13, 2015

(65) Prior Publication Data

US 2015/0300580 A1 Oct. 22, 2015

Related U.S. Application Data

(60) Provisional application No. 61/980,972, filed on Apr. 17, 2014.

(51) Int. Cl.

| | |
|---|---|
| ***F21V 7/00*** | (2006.01) |
| ***F21L 4/00*** | (2006.01) |
| ***F21V 5/00*** | (2015.01) |
| ***F21V 5/04*** | (2006.01) |
| ***F21V 17/02*** | (2006.01) |
| *F21Y 101/02* | (2006.01) |
| *F21V 14/00* | (2006.01) |

(Continued)

(52) U.S. Cl.

CPC ..... *F21V 7/0091* (2013.01); *F21L 4/005* (2013.01); *F21V 5/006* (2013.01); *F21V 5/04* (2013.01); *F21V 17/02* (2013.01); *F21V 14/006* (2013.01); *F21V 17/002* (2013.01); *F21V 21/0885* (2013.01); *F21V 23/0428* (2013.01); *F21Y 2101/02* (2013.01)

(58) Field of Classification Search

CPC ..... F21V 5/006; F21V 5/04; F21V 7/0091; F21V 14/006; F21V 17/002; F21V 17/02; F21V 21/0885; F21V 23/0428; F21Y 2101/02; F21L 4/005

USPC ..... 362/311.02, 187, 208

See application file for complete search history.

(56) References Cited

U.S. PATENT DOCUMENTS

| | | |
|---|---|---|
| 6,474,837 B1 | 11/2002 | Belliveau |
| 6,633,152 B2 | 10/2003 | Sharrah et al. |

(Continued)

FOREIGN PATENT DOCUMENTS

| | | |
|---|---|---|
| WO | 2008/091931 | 7/2008 |
| WO | 2011/023957 | 3/2011 |

OTHER PUBLICATIONS

G.T. Price Products, Inc., "Smoke-Cutter Flashlights", Aug. 20, 1987, 1 page.

(Continued)

*Primary Examiner* — Laura Tso

(74) *Attorney, Agent, or Firm* — Clement A. Berard, Esq.; Dann, Dorfman, Herrell & Skillman, PC

(57) ABSTRACT

A portable light may comprise: a light body and a light source supported thereby and selectively energizable for producing light; a switch for selectively energizing the light source; a TIR optical element disposed in front of the light source for receiving the light produced thereby, and form the light into a collimated beam of light, the TIR optical element having a recess in a forward face thereof; and a selectable beam modification element placeable into and removable from the recess in the forward face of the TIR optical element.

19 Claims, 10 Drawing Sheets

(51) Int. Cl.

| | |
|---|---|
| *F21V 17/00* | (2006.01) |
| *F21V 21/088* | (2006.01) |
| *F21V 23/04* | (2006.01) |

(56) References Cited

U.S. PATENT DOCUMENTS

| | | | | |
|---|---|---|---|---|
| 7,222,995 | B1 | 5/2007 | Bayat et al. | |
| 7,549,766 | B2 | 6/2009 | Sharrah et al. | |
| 7,581,847 | B2 | 9/2009 | Dalton | |
| 7,651,240 | B2 | 1/2010 | Bayat et al. | |
| 7,745,957 | B2 | 6/2010 | Bayat et al. | |
| 8,403,526 | B2 | 3/2013 | Bayat et al. | |
| 2009/0027876 | A1 | 1/2009 | Yu | |
| 2009/0237943 | A1* | 9/2009 | Schmidt | B60Q 3/0253 362/311.02 |
| 2010/0165633 | A1 | 7/2010 | Moolman et al. | |
| 2011/0069496 | A1* | 3/2011 | Ing | B29D 11/00798 362/311.02 |
| 2011/0096553 | A1* | 4/2011 | Shimokawa | F21V 5/04 362/311.02 |
| 2013/0322089 | A1* | 12/2013 | Martis | F21V 13/14 362/311.02 |
| 2014/0126220 | A1* | 5/2014 | Chen | F21K 9/1355 362/311.02 |
| 2014/0146545 | A1* | 5/2014 | Shum | F21K 9/13 362/311.02 |
| 2014/0177234 | A1* | 6/2014 | Wang He | F21V 5/048 362/311.02 |
| 2015/0029723 | A1* | 1/2015 | Lo | F21K 9/50 362/293 |

OTHER PUBLICATIONS

G.T. Price Products, Inc., "Smoke Cutter", Fire Chief, Jul. 1989, 1 page.

G.T. Price Products, Inc., "The Professional Line with the Extras", Jan. 1991, 2 pages.

G.T. Price Products, Inc., "Code-4", prior to filed Apr. 13, 2015, 1 page.

G.T. Price Products, Inc., "New Compact Headlamps", prior to filed Apr. 13, 2015, 1 page.

Pelican Products, "VersaBrite 2250 Operating Instructions", © 2010, 2 pages.

Sharrah, Jonathan R., et al., "Portable Light", U.S. Appl. No. 14/260,369, filed Apr. 24, 2014, 50 pages.

* cited by examiner

REAR

FRONT

PORTABLE LIGHT WITH SELECTABLE OPTICAL BEAM FORMING ARRANGEMENT

This Application claims the benefit of U.S. Provisional Patent Application No. 61/980,972 entitled "PORTABLE LIGHT WITH SELECTABLE OPTICAL BEAM FORMING ARRANGEMENT" which was filed on Apr. 17, 2014 and which is hereby incorporated herein by reference in its entirety.

The present invention relates to a portable light having an optical beam forming arrangement.

Portable lights are used in many environments to provide illumination and to enable personnel to operate in those environments. In certain environments, visibility may be reduced by smoke, particles, fog, steam or other matter suspended or floating in the air, e.g., in environments often encountered by firefighters, police, security and other first responder personnel, as well as in military and rescue environments. Often these kinds of environments may be hazardous and/or dangerous to personnel, and so the reduced visibility created by such environments can increase the level of hazard and/or danger.

Typically, a bright light is necessary to penetrate such environments, however, such environments tend to reflect light back towards the portable light and thereby can tend to "blind" the personnel using the portable light. Peripheral light is particularly offensive when reflected back. One way to reduce this reflection-induced blinding is to employ a highly collimated beam of light thereby to reduce any peripherally projected light.

Conventionally, lights employ a highly collimating parabolic reflector and an opaque cover, e.g., as by a black opaque area on an incandescent light source, to block peripheral light. Thus the light intensity at the center of the light beam is increased relative to the intensity at the periphery thereof. However, when the light is employed in other environments, the absence of peripheral light may be a disadvantage.

With the advent of modern high light output solid state light sources, e.g., light emitting diode (LED) light sources, a parabolic reflector is less efficient because the LED does not emit light relatively evenly over a complete spherical volume as does an incandescent source. Typically, modern LEDs include an integral curved plastic lens so as to produce light relatively evenly over a hemispherical volume. Typically, many modern LED lights employ an optical arrangement in which internal reflection of light within an optical element is utilized to shape a forward projecting collimated light beam. Also typically, a level of peripheral light is provided by light that is directly emitted from the LED and/or by light diffusing elements to redirect light toward the periphery of the light beam. A permanent opaque plate has been employed to block the direct forward projected light from the LED.

Applicant believes there is a need for a portable light that is easily configurable to provide a reduced light intensity at the center of its light beam when that characteristic is desired, and that is also easily configurable to not provide such reduced light intensity at other times.

Accordingly, a portable light may comprise: a light body and a light source supported thereby and selectively energizable for producing light; a switch for selectively energizing the light source; a TIR optical element disposed in front of the light source for receiving the light produced thereby, and form the light into a collimated beam of light, the TIR optical element having a recess in a forward face thereof; and a selectable beam modification element placeable into and removable from the recess in the forward face of the TIR optical element.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include.

Figures 1A, 1B:
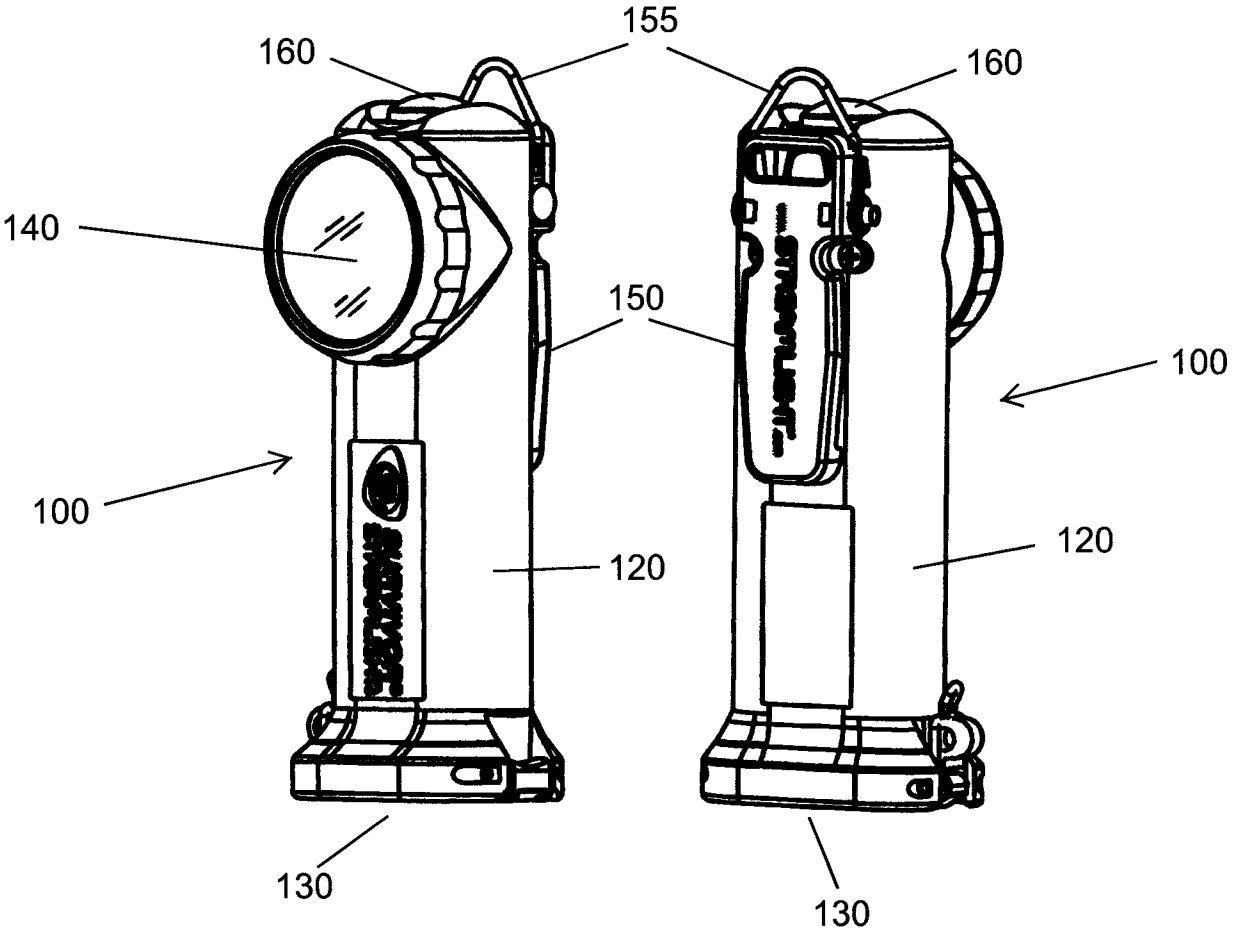
FIGS. 1A and 1B which are front and rear perspective views of an example embodiment of a portable light, FIGS. 1C and 1D which are front and rear views thereof, and FIGS. 1E and 1F which are top and bottom views thereof, respectively.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification. According to common practice, the various features of the drawing are not to scale, and the dimensions of the various features may be arbitrarily expanded or reduced for clarity, and any value stated in any Figure is given by way of example only.

DESCRIPTION OF THE PREFERRED EMBODIMENT(S)

Figure 1C:
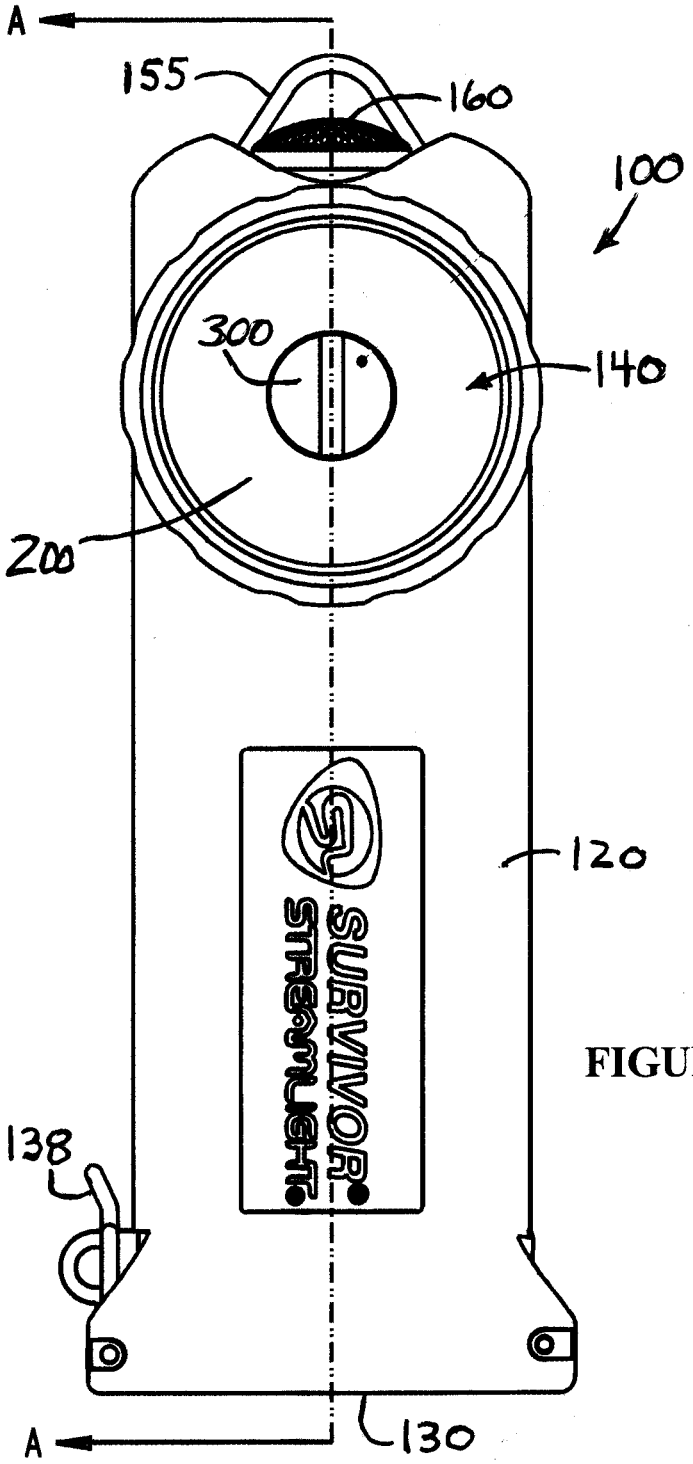
Figure 1D:
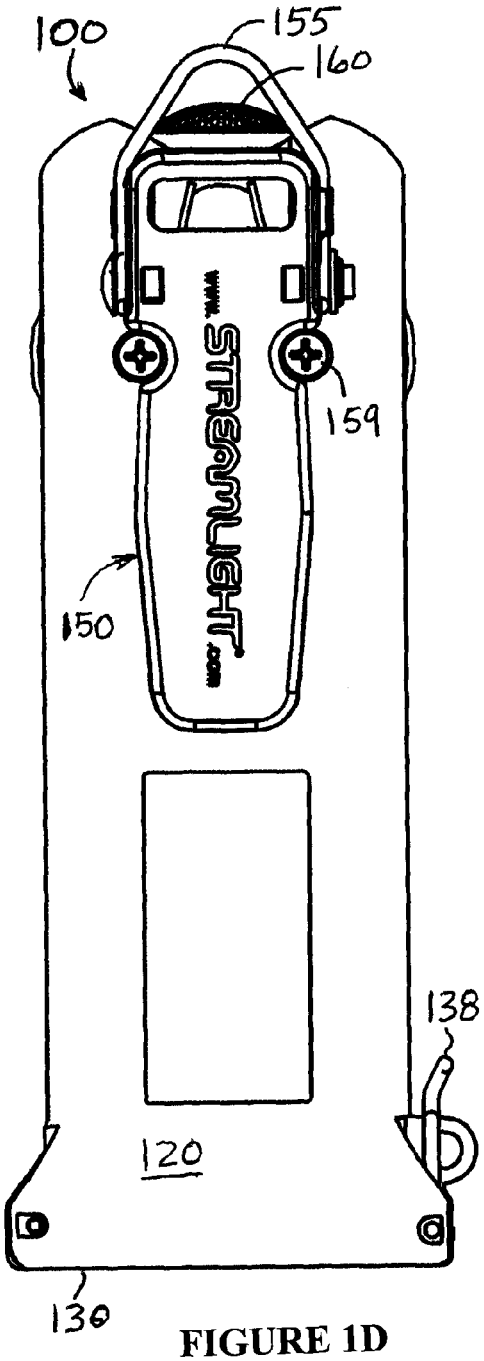
Figure 1E:
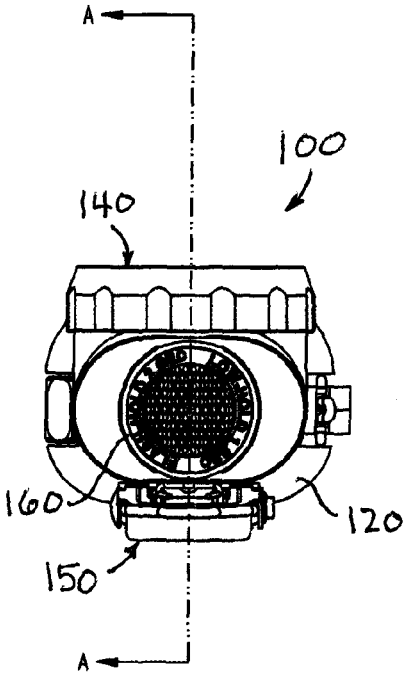
Figure 1F:
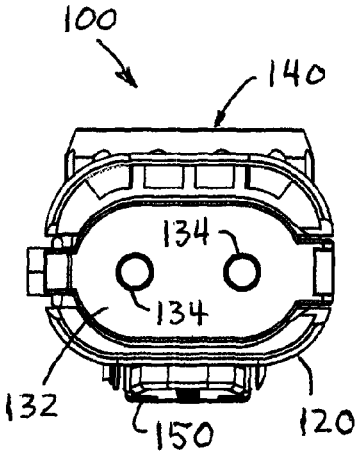
Figure 2:
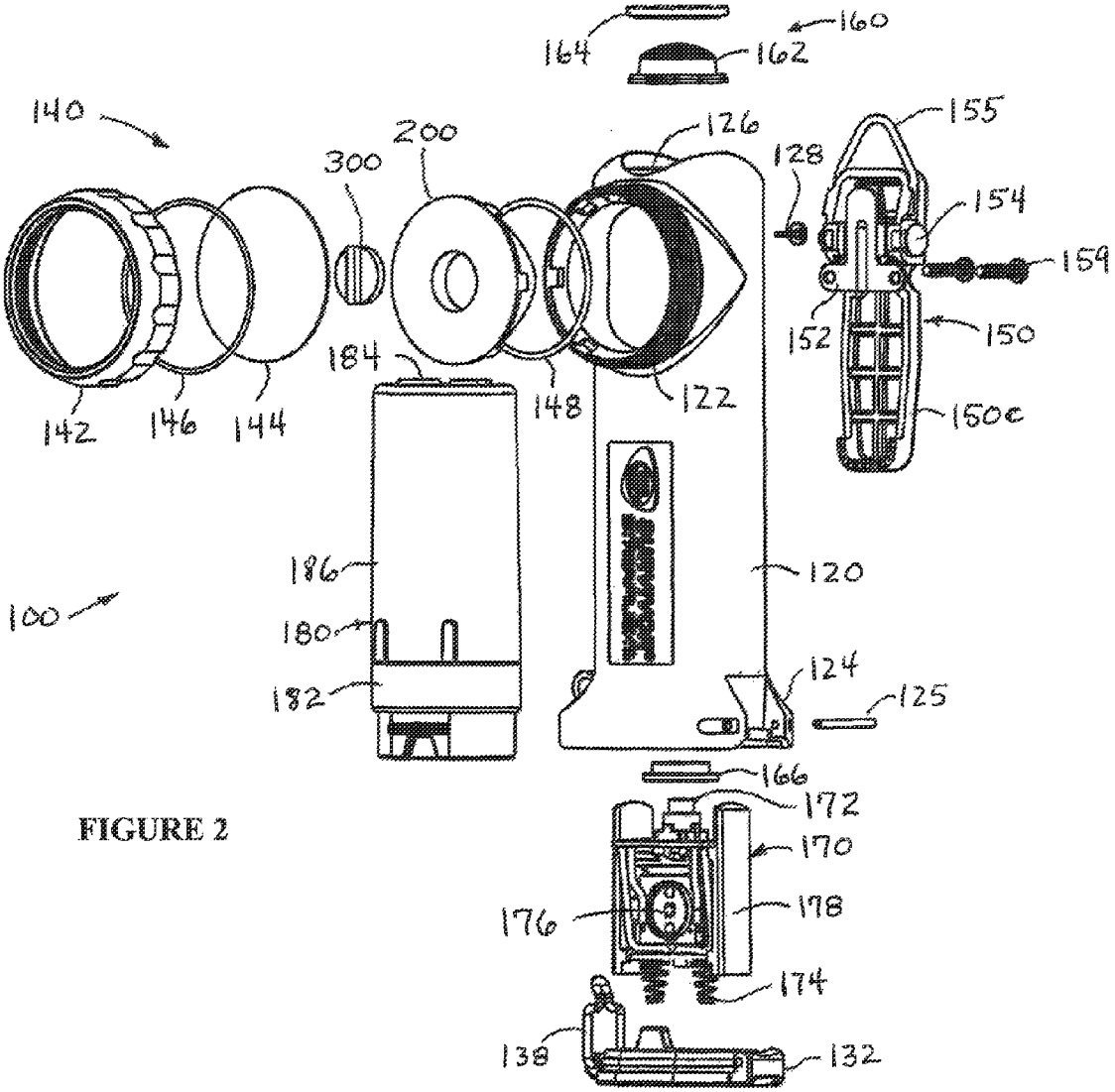
FIG. 2 is an exploded perspective view of the example portable light of FIG. 1.
Figure 3:
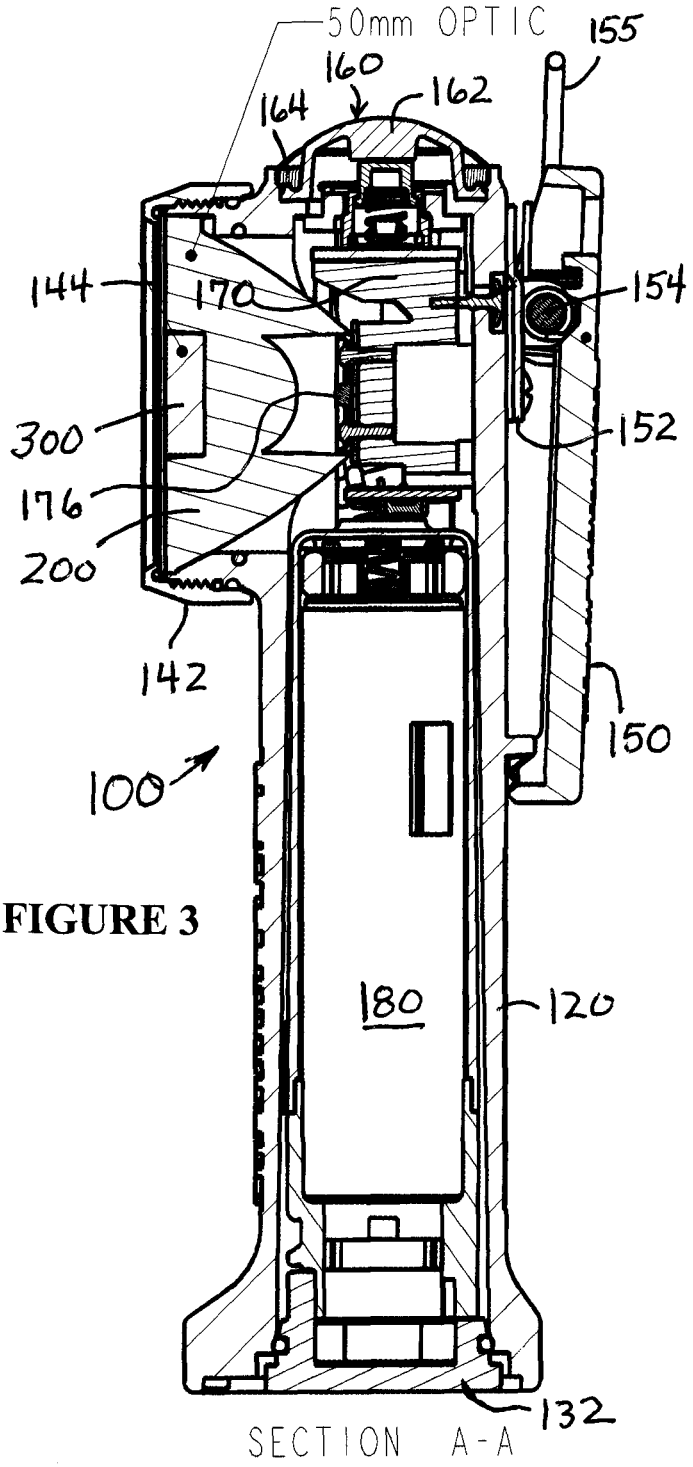
FIG. 3 is a cross-sectional view of the example portable light including an example embodiment of an optical beam forming arrangement.

FIG. 1 includes FIGS. 1A and 1B which are front and rear perspective views of an example embodiment of a portable light 100, FIGS. 1C and 1D which are front and rear views thereof, and FIGS. 1E and 1F which are top and bottom views thereof, respectively; FIG. 2 is an exploded perspective view of the example portable light 100 of FIG. 1; and FIG. 3 is a cross-sectional view of the example portable light 100 including an example embodiment of an optical beam forming arrangement 200-300 therefor. Portable light 100 includes a body or housing 120 that is configured to have a base 130 upon which light 100 can rest, e.g., on a horizontal surface, and to have a light source 140 that when energized projects light in a direction substantially perpendicularly to the long axis (e.g., vertical axis) of body 120.

Light 100 preferably, but optionally, includes a clip 150 on light body 120 by which it can be attached (e.g., clipped) to an article of clothing or to equipment or to another object, e.g., a belt or strap or rope or bar, as well as a hanger or loop 155 by which it can be attached (e.g., hung) from an article of clothing or equipment or another object. Hanger 155 is attached to light body or housing 120 by a bracket, e.g., the bracket 152 that supports clip 150, and more specifically, hanger 155 is pivotable on the pivot or hinge pin 154 on which clip 150 pivots on that bracket 152 relative to housing 120.

A switch actuator 160 is provided for selectively energizing and de-energizing light source 130. Preferably switch actuator 160 is at the upper end on body 120 where it can easily be actuated by a finger when light 100 is held in hand or can be pressed when light 100 is resting on a horizontal surface or is attached by clip 150 or hung by loop 155. Also preferably, light source 140 is proximate the upper end of light body 120.

Light body or housing 120 is preferably a hollow tube 120, e.g., a molded plastic tube, having a receptacle 1*b* for receiving elements, e.g., elements 142-148, 176, 200, 300, of light source 130 extending substantially perpendicularly from the upper end of body 120, and having an opening 126 at the upper end thereof for receiving elements, e.g., elements 162-166, of switch actuator 160. A switch boot 162 of switch actuator 160 is attached over an opening 126 in the upper end of housing 120 by a switch ring 164 which is attached to housing 120, e.g., by adhesive or by welding or by another suitable method to sealingly attach boot 162 thereto. A switch spacer 166 is disposed behind switch boot 162 for transmitting a pressing of boot 162 to actuate an electrical switch 172 which is adjacent thereto when LED module assembly 170 is inserted into housing tube 120 through the opening at the base 130 thereof and is fully seated against the upper end thereof.

LED module assembly 170 includes, e.g., a heat sink structure 178 to an upper end of which is mounted electrical switch 172 and to a lower end of which are mounted a pair of spring contacts 174 for making electrical connections to a battery assembly 180. Heat sink structure 178 is substantially rectangular with two substantially parallel opposing sides thereof having extensions projecting upwardly and downwardly, e.g., to increase the heat sinking area and mass thereof. A preferably integral wall fills the rectangular center of heat sink 178 and thermally connects to all sides thereof and presents a mounting surface substantially in the plane of heat sink 178. Mounted to that mounting surface of heat sink structure 178 is a light emitting diode (LED) 176, which is also an element of light source 140. LED 176 is mounted in a position to direct light substantially outward and away from that surface of heat sink 178 and around a perpendicular to the long axis of housing 120, e.g., into the base of optical element 200, as described below.

Battery assembly 180 includes an inner carrier structure 182 which carries, e.g., a plurality of battery cells (not shown) and provides interconnections therebetween and an outer carrier cover 186. Carrier 182 includes a pair of contacts 184 at its upper end, e.g., accessible through openings in the upper end of carrier cover 186, for making electrical connection to the spring contacts 174 extending from LED module 170. Battery assembly 180 may contain either single use battery cells or rechargeable battery cells. Where battery assembly 180 contains rechargeable battery cells, carrier cover 186 may be permanently attached to inner carrier 182. In that embodiment, battery assembly 180 preferably also provides a pair of contacts at its lower end for making electrical connection to optional connections 134 through battery door 132.

Battery door 132 is hinged by pin 125 engaging a clevis 124 at the base of housing 120 and preferably includes a pair of contacts 134 there through for connecting battery carrier 180 internal to light 100 to an external source of charging power, e.g., a charger base, when light 100 is placed therein for charging rechargeable batteries that may be utilized in light 100. Battery door 132 includes a pivotable clasp 138 for securing battery cover 132 in a closed position in housing 120, and may also include an O-ring, gasket or other seal for sealing the battery door end of housing 120.

Light source 140 may be provided by an LED 176 of LED module assembly 170 in conjunction with elements 142-148, 200, 300. Optical element 200 is a shaped optically clear plastic element 210 that has a polished generally parabolic external side surface 240, a generally wider flat polished forward surface 220, and a shaped narrower rearward surface 230 that is disposed adjacent to LED 176 of LED module assembly 170. LED 176 may be surrounded by a raised ring sized and shaped to receive the rearward end 230 of optical element 200. Polished side surface 240 may be a generally parabolic surface or other suitably shaped surface to collimate the light produced by LED 176 into a desired beam, e.g., a collimated forward projecting light beam.

Optical element 200 is covered by a lens 144 and both are retained in the threaded receptacle 122 of housing 120 by a lens ring 142. Preferably Lens ring 142 has threads, e.g., internal threads, that engage complementary threads, e.g., external threads, of receptacle 122 for securing lens ring 142, lens 144 and optical element 200 in housing 120. Preferably, but optionally, an O-ring 146 may be provided between lens ring 142 and lens 144 to provide a seal thereat and housing 120 may have a second O-ring 148 around outer periphery of receptacle 122 for sealing between lens ring 144 and housing 120.

Figure 4:
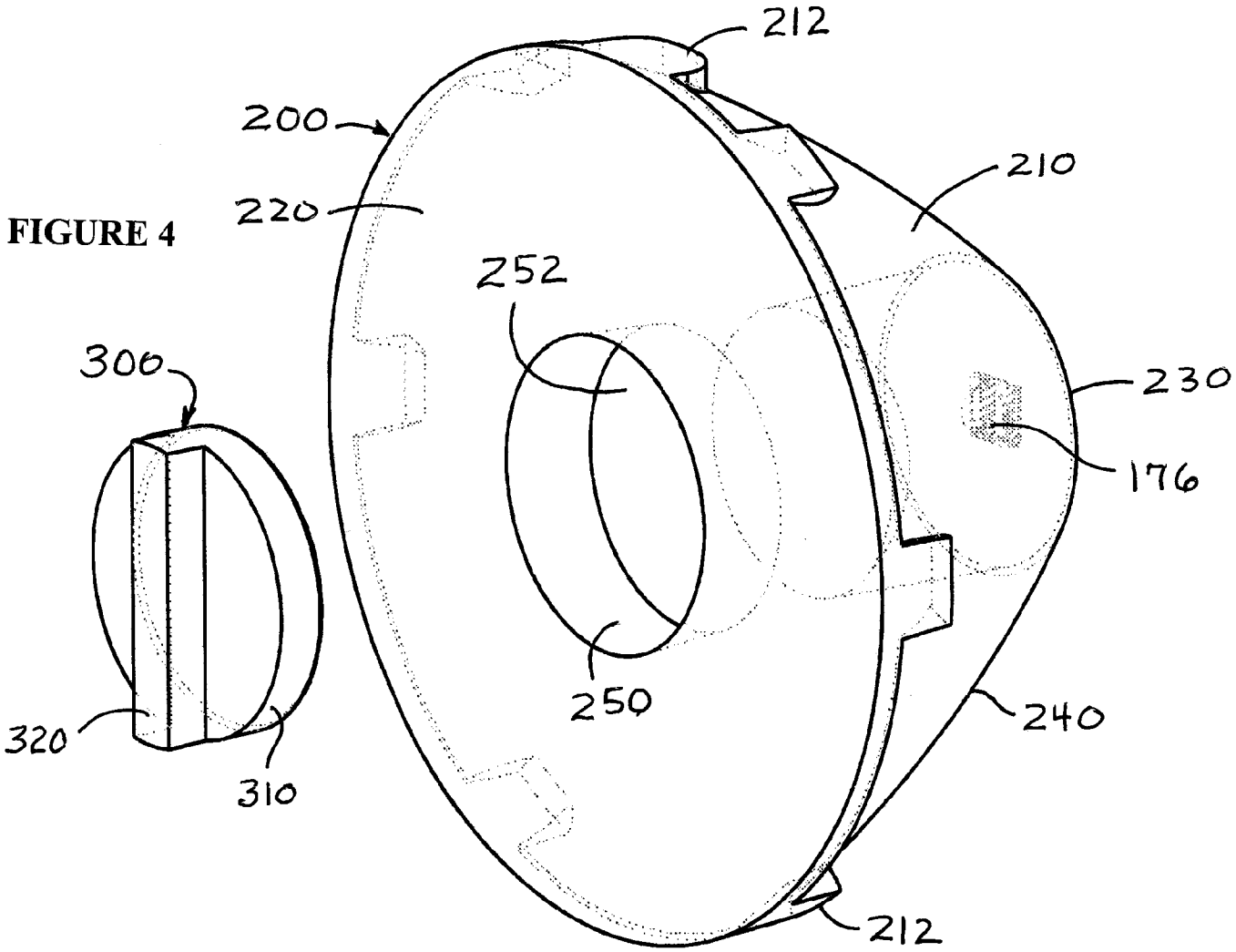
FIG. 4 is a perspective view of the example beam forming arrangement of FIG. 3.
Figure 5B:
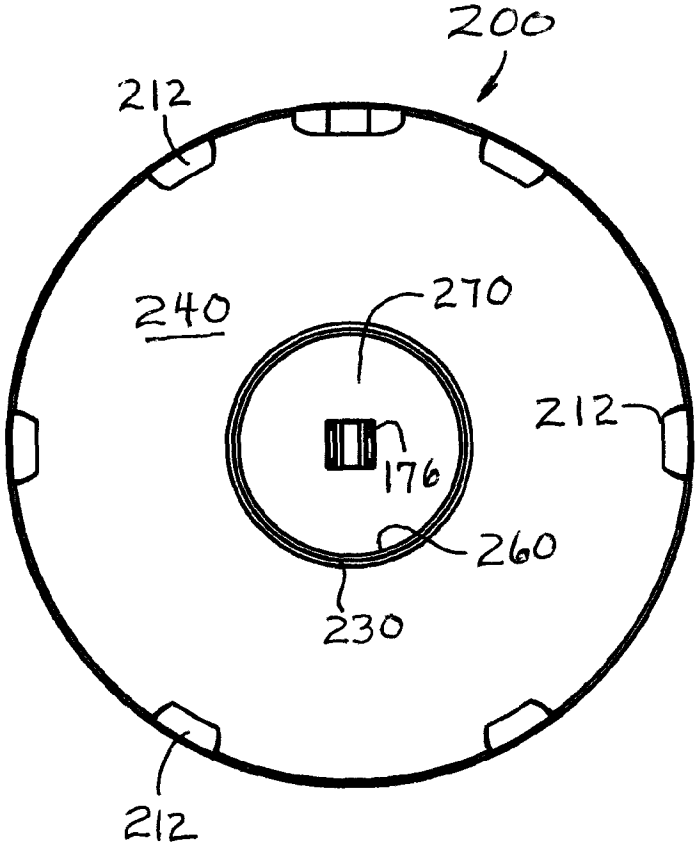
FIGS. 5A, 5B and 5C which are first and second end views and a side cross-sectional view of the example optical beam forming arrangement of FIG. 4.
Figure 5A:
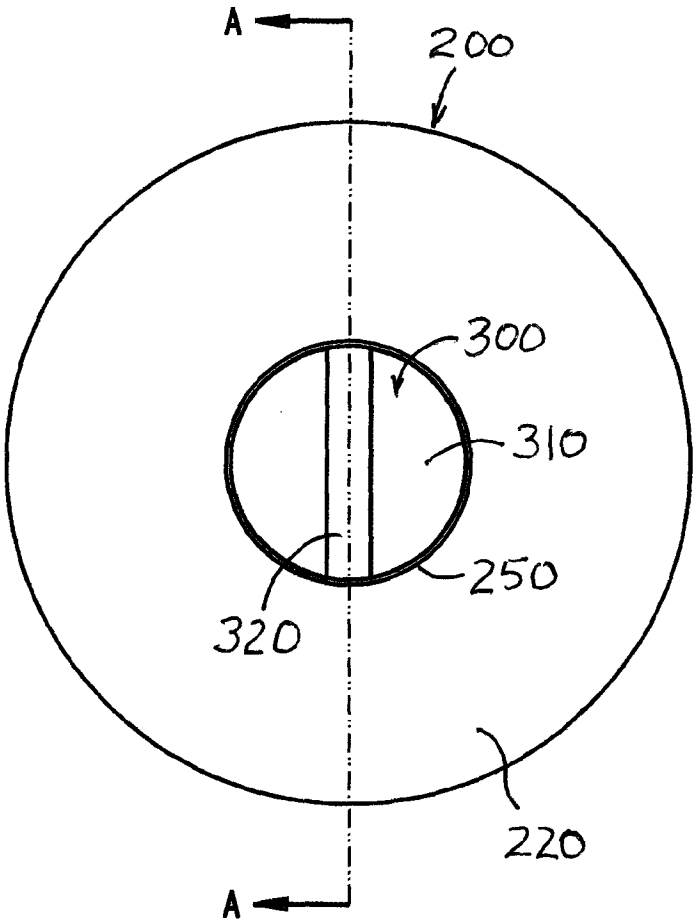
Figure 5C:
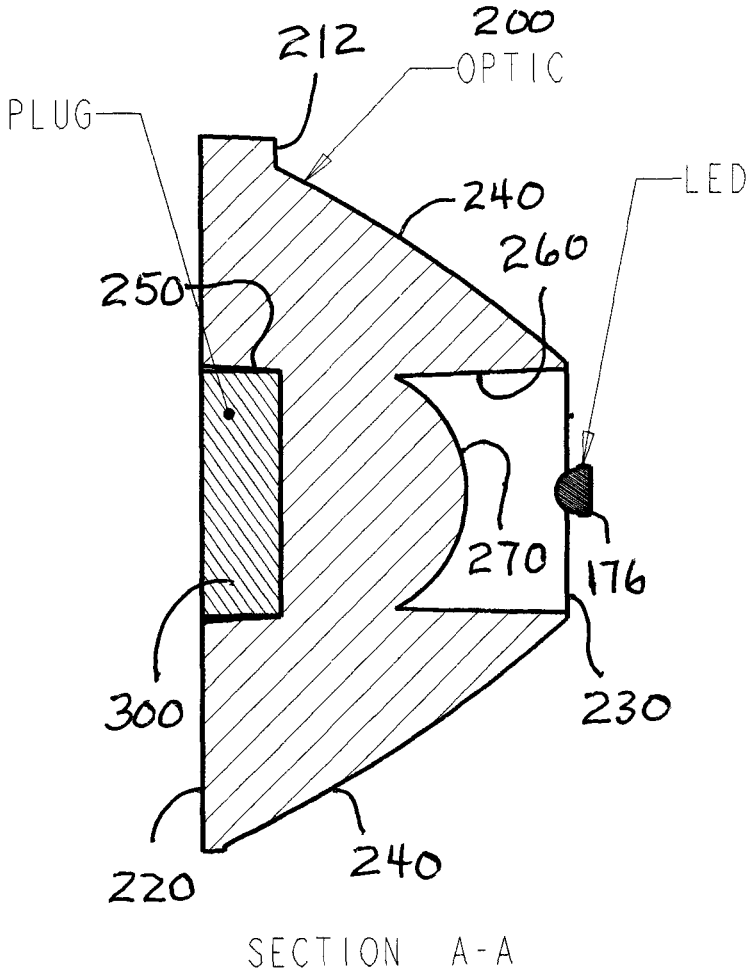

Preferably, but optionally, a pivotable clip assembly 150 includes a pivotable clip 150*c* and is attached at a bracket 152 thereof to housing 120 by one or more fasteners 159, e.g., two screws 159. Clip assembly 150 includes the clip 150*c* which is pivotably mounted to bracket or base 152 by a pivot pin 154, and has hanger or loop 155 that is pivotable by the ends thereof pivotably engaging hinge pin or pivot pin 154 on which clip 155 pivots. Housing 120 may be provided with a pressure relief valve 128, typically a resilient valve 128, disposed in an opening in housing FIG. 4 is a perspective view of the example beam forming arrangement 200, 300 of FIG. 3; and FIG. 5 includes FIGS. 5A, 5B and 5C which are first and second end views and a side cross-sectional view of the example optical beam forming arrangement 200, 300 of FIG. 4. Optical element 200 is a shaped optically clear plastic element whose optically clear body 210 has a curved polished side surface 240, a generally wider flat polished forward surface 220, and a narrower rearward shaped surface that is disposed adjacent to LED 176 of LED module assembly 170 as described. Light produced by LED 176 enters optical element 200 through the rearward end 230 thereof, is essentially totally internally reflected therein to form a highly collimated beam of light, and exits optical element 200 at the flat forward exit surface 220 thereof. Thus the totally internally reflective (TIR) optical element 200 serves to redirect the rays of light emitted by LED 176, which are emitted therefrom substantially radially into a substantially hemispherical volume, into substantially parallel rays of light defining a highly collimated beam of light that exits forward surface 220 of optical element substantially parallel to the central axis, e.g., the axis of optical symmetry, thereof.

More specifically, light emitted by LED 176 impinges on and is refracted by the side wall of the rearward cylindrical recess 260 and into the body 210 of optical element 200 wherein it is totally internally reflected (TIR) by surface 240 to exit via the flat forward face 220 thereof as a highly collimated beam. While most of the light entering via the side wall 260 is believed to come directly from LED 176, LED 176 is not a true point source and so some rays may be reflected by surface 270 towards side wall 260. Because optical element 200 is highly efficient in collecting and in internally reflecting and collimating the light emitted by LED 176, very little light is emitted toward the periphery of optical element 200.

A substantially cylindrical recess 260 at the rearward end of optical element 200 has a curved convex bottom 270 for refracting light from LED 176 into optical body 210 in a direction towards the bottom 252 of cylindrical recess 250 in the flat forward surface 220 thereof, from which it exits optical element 200. Preferably, the light exiting optical element 200 is diffused through the textured bottom surface 252 of recess 250 to provide peripheral light. The cylindrical recess 250 provided in the flat forward face 220 of optical element 200 in an available embodiment thereof has a flat textured bottom surface 252 so as to diffuse light from LED 176 that impinges upon surface 252 thereby to provide the peripheral light.

Because peripheral light is sometimes desirable and sometimes is not desirable, Applicant provides a selectable beam modification element 300 that enables a user to easily reconfigure portable light 100 to provide the desired level of peripheral light. A removable beam modification element 300, e.g., a removable plug element 300, may be disposed in the cylindrical recess 250 in the forward surface of optical element 200, whereat is can block or otherwise modify one or more characteristics of the light exiting through surface 252, e.g., which can provide peripheral light. Preferably removable beam modification element 300, e.g., removable plug element 300, has an opaque body or base 310 so as to maximize the peripheral light that it blocks.

It has been found that if the peripheral light is amber in color, it can be less objectionable and less fatiguing to a user than is white peripheral light, at least in some environments. Accordingly, a removable beam modification element 300, e.g., removable plug element 300, that has a body 310 of transparent or translucent amber colored material, e.g., plastic, may be provided, either in place of and/or in addition to an opaque plug 300, to modify the color or the intensity or both of the peripheral light, e.g., to be amber in color.

One example embodiment of removable beam modification element 300, e.g., removable plug element 300, preferably comprises an opaque cylindrical body 310 having a diameter that is slightly smaller than the diameter of the cylindrical recess 250 in the forward face of optical element 200 and being of lesser thickness than the depth thereof.

Intuitively, one might expect that placing an opaque beam modification element 300 directly in front of LED light source 176 would substantially diminish the light intensity at the center of the light beam emitted by light 100 and would have little effect upon the intensity of peripheral light, which beam modification element 300 does not appear to be in position to affect. Surprisingly, however, Applicant has found that the light intensity of the light near the center of the emitted light beam is not substantially diminished by beam modification element 300 while the intensity of the peripheral light is substantially diminished or otherwise modified.

Optical element 200 may include on optical body 210 thereof one or more orientation defining features 212, e.g., one or more projections 212, that may engage one or more corresponding orientation features, e.g., one or more recesses, in the housing 120, 122 into which optical element 200 is placed. Where the orientation of optical element 200 into housing 120, 122 is desired to be a particular orientation, then orientation features 212 may be arranged in a non-symmetrical pattern.

Selectable beam modification element 300 is preferably of a size and shape corresponding to that of the recess 250, preferably a cylindrical recess, e.g., recess 250, in the forward face of optical element 200 so that it can easily be placed into that recess and can easily be removed from that recess, thereby to reconfigure portable light 100 to produce a lesser and a greater level of peripheral light. Typically, and preferably, the base of selectable beam modification element 300 may be a cylindrical disk having a diameter that is slightly less than that of the cylindrical recess of optical element 200, and having a thickness (or length) that may be the same as, less than or greater than the depth of the cylindrical recess.

Preferably, but optionally, removable beam modification element 300 may have a raised gripping member 320, e.g., a raised ridge 320 or a sphere 320 on a short post, so that removable beam modification element 300 may easily be gripped and removed from the cylindrical recess 250 in optical element 200.

Selectable beam modification element 300 may be removably retained in the recess 250 of optical element 200 in any one or more of a variety of different arrangements. For example, selectable beam modification element 300 may be removably retained in the recess of optical element 200 by friction, or may have a resilient periphery that contacts the inner surface of the recess 250 in optical element 200, or may be of a resilient material and of a diameter to contact the inner surface of the recess 250 in optical element 200, or may have an O-ring in a peripheral groove that contacts the inner surface of the recess 250 in beam modification element 300, or may be retained by pressure where the difference between the diameters of selectable beam modification element 300 and the recess 250 are small. In the illustrated embodiment, selectable beam modification element 300 is retained by a cover provided by lens 10 and lens ring 11, however, a cover of a different form, e.g., a press in or snap in cover, may also be employed.

Further, selectable beam modification element 300 may be opaque or may be transparent or translucent and of any desired color, or plural different beam modification elements 300 may be provided with light 100. For example, selectable beam modification element 300 may be of a transparent amber colored material so that the peripheral light is amber in color which is believed to be less fatiguing when reflected by smoke or other particulates in an environment. The intensity of the peripheral light is directly related to the light transmissibility of the material from which selectable beam modification element 300 is made, and so the material employed may be selected to provide a desired level of peripheral light intensity. Further, selectable beam modification element 300 may be of materials of other colors, e.g., red, blue, green, yellow and the like, as may be desired for coloring the peripheral light for a given environment and/or preference, or for merely distinguishing by its color one light 100 from another light 100.

As a result of selectable beam modification element 300 being removably retained in optical element 200, portable light 100 is easily configurable and reconfigurable by a user to produce a beam of light having a lesser peripheral light intensity or a greater peripheral light intensity, as well as to configurations producing peripheral light of different colors and/or intensities.

Figure 6B:
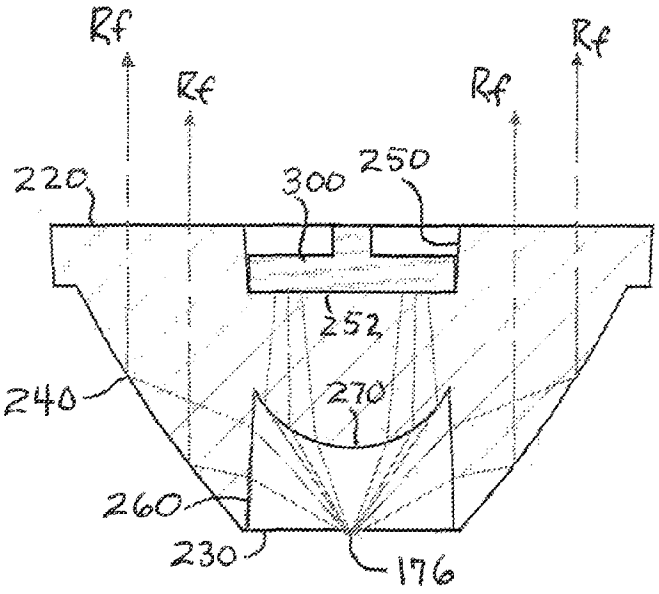
FIGS. 6A and 6B which are side cross-sectional views of the example optical beam forming arrangement of FIG. 4 illustrating example light paths therethrough.
Figure 6A:
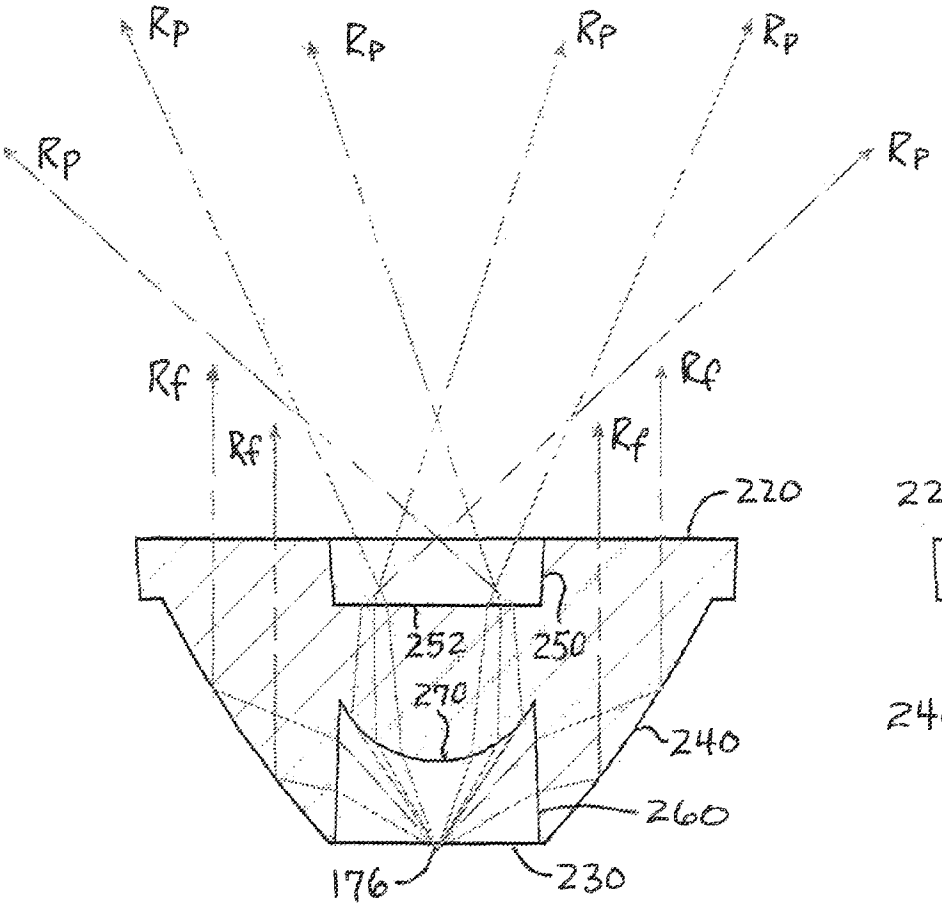

FIG. 6 includes FIGS. 6A and 6B which are side cross-sectional views of the example optical beam forming arrangement 200, 300 of FIG. 4 illustrating example light paths therethrough. Light emitted by LED 176 is portrayed as an idealized point source from which example rays of light are illustrated to emanate radially. As fully described above, light from LED 176 enters optical element 200 through the surfaces of cylindrical recess 260 and curved bottom 270 thereof from which they exit as substantially collimated rays Rf that provide a high intensity forwardly directed spot beam of light or as diffuse rays Rp that provide peripheral light.

When beam modification element 300 is placed into recess 250 of optical element 200 it blocks light rays Rp which may be absorbed by beam modification element 300 and/or reflected back into optical element 200, and possibly partially absorbed and partially reflected as a practical matter.

Figure 7A:
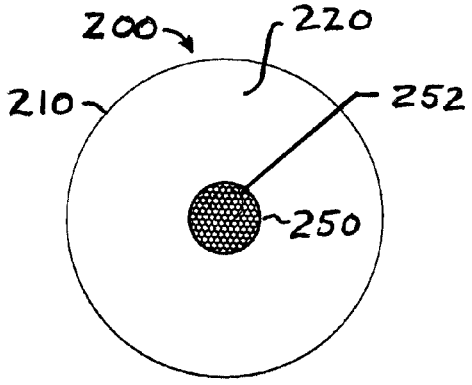
FIGS. 7A, 7B and 7C which are a first end view, a side view and a second end view
Figure 7B:
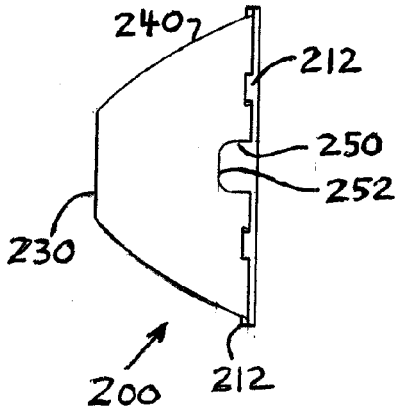
Figure 7C:
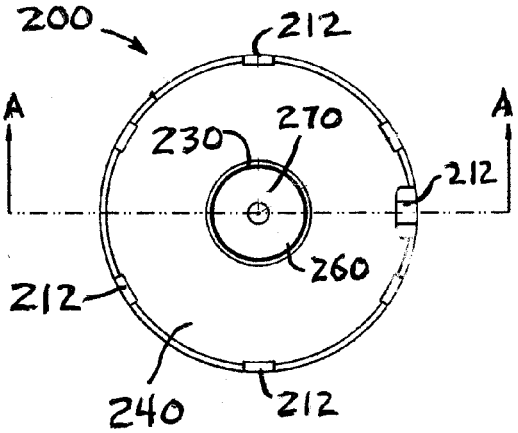
Figure 7D:
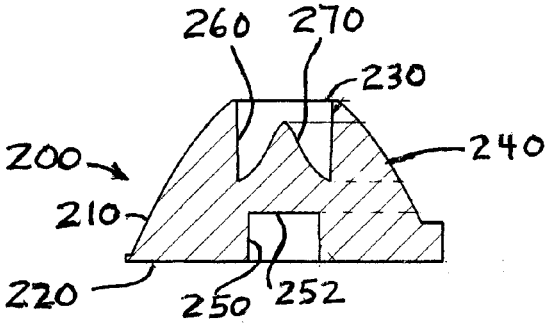
FIG. 7D is a side cross-sectional view of another example optical beam forming arrangement of FIG. 4.

FIG. 7 includes FIGS. 7A, 7B and 7C which are a first end view, a side view and a second end view and FIG. 7D is a side cross-sectional view of another example optical beam forming arrangement 200 of FIG. 4. The optical beam forming element illustrated therein is substantially similar to that of FIGS. 5-6, except for the dimensions of certain features thereof and the shape of surface 270 thereof. Cylindrical recesses 250 and 260 in the forward and rearward surfaces 220, 230 thereof are of smaller diameter and of greater depth, and the shapes of curved surface 270 differs in that it is a cone-like peak having curved concave sides, thereby to better reflect light from LED 176 into the side walls of cylindrical recess 260.

In a typical embodiment, TIR optical element 200 and lens 142 may be of an optically clear material, e.g., a glass, polycarbonate, polystyrene, PMMA (acrylic), acrylic, styrene acryl nitride (SAN), or another suitable clear plastic, glass or other suitable optical material. One example embodiment of optical element 200 is about 1.97 inches (about 50 mm) in diameter at its wide flat end, about 0.68 inch (about 17.3 mm) in diameter at its narrower end, and about 1.0 inch (about 25.4 mm) in depth front to rear. Forward cylindrical recess 250 thereof is about 0.70 inch (about 17.8 mm) in diameter and about 0.24 inch (about 6.1 mm) in depth, and rear recess 260 is about 0.67 inch (about 17 mm) in diameter and about 0.46 inch (about 11.7 mm) in depth. An example selectable beam modification element 300 therefor may be of acrylic, styrene or another suitable plastic, and is slightly less than about 0.67 inch (about 17 mm) in diameter and about 0.11 inch (about 2.8 mm) thick.

Another example embodiment of beam modification element 200 is about 1.97 inches (about 50 mm) in diameter at its wide flat end, about 0.65 inch (about 16.5 mm) in diameter at its narrower end, and about 1.0 inch (about 25.4 mm) in depth front to rear. Forward cylindrical recess 250 thereof is about 0.45 inch (about 11.4 mm) in diameter and about 0.3 inch (about 7.6 mm) in depth, and rear recess 260 is about 0.59 inch (about 15 mm) in diameter and about 0.50 inch (about 12.7 mm) in depth. An example selectable beam modification element 300 therefor may be of acrylic, styrene or another suitable plastic, and is slightly less than about 0.45 inch (about 11.4 mm) in diameter and about 0.11 inch (about 2.8 mm) thick.

In the aforementioned examples of optical element 200, side surface 240 has a shape that is a series of arches and curved bottom 270 has a domed or peaked shape as illustrated, one example being rounded and convex, almost parabolic and not quite spherical, and the other example being a curved sided peaked conical dome with concave side curvature.

One example of an LED module and heat sink of the sort suitable for use in light 100 and similar to that described herein is described in U.S. Pat. No. 7,883,243 issued Feb. 8, 2011 and entitled "LED FLASHLIGHT AND HEAT SINK ARRANGEMENT" which is assigned to Streamlight, Inc. of Eagleville, Pa., which is hereby incorporated herein by reference in its entirety.

A portable light 100 may comprise: a light body 120 for receiving a source of electrical power; a light source 140, 176 supported by the light body 120 and selectively energizable for producing light; a switch 160, 172 supported by the light body 120 for selectively energizing the light source 140, 176 from the source of electrical power; a TIR optical element 200 having a rearward end disposed in front of the light source 140, 176 for receiving the light produced thereby, the TIR optical element 200 employing total internal reflection to form light produced by the light source 140, 176 into a collimated beam of light, the TIR optical element 200 having a recess 250 in a forward face thereof; a selectable beam modification element 300 having a size and shape corresponding to the recess 250 in the forward face of the TIR optical element 200, wherein the selectable beam modification element 300 is placeable into the recess 250 in the forward face of the TIR optical element 200 and is removable from the recess 250 in the forward face of the TIR optical element 200; and means for removably retaining the selectable beam modification element 300 in the recess 250 in the forward face of the TIR optical element 200. The means for removably retaining may include: friction between the selectable beam modification element 300 and the recess 250, pressure urging the selectable beam modification element 300 into the recess 250, a cover, a lens, a lens and ring, a press in cover, a snap in cover, the selectable beam modification element 300 having a resilient periphery, the selectable beam modification element 300 being of a resilient material, the selectable beam modification element 300 having a diameter to contact the inner surface of the recess 250 in the TIR optical element 200, the selectable beam modification element 300 having an O-ring in a peripheral groove, or a combination thereof. The selectable beam modification element 300 may be opaque, or transparent, or translucent, or a color, or a combination thereof. The TIR optical element 200 may comprise: a shaped optically clear plastic element 210 having a polished curved external side surface 240, a generally wider flat forward surface 220, and a narrower rearward shaped surface 230, 260, 270. The TIR optical element 200 may have: a substantially cylindrical recess 260 at the rearward shaped surface thereof, the substantially cylindrical recess 260 having a curved convex bottom or a peaked conical bottom having concave sides for reflecting light through a side wall of the cylindrical recess 260; or a cylindrical recess 250 in the flat forward face thereof having a textured surface at the bottom thereof; or a substantially cylindrical recess 260 at the rearward shaped surface thereof, the substantially cylindrical recess 260 having a curved convex bottom or a peaked conical bottom having concave sides for reflecting light through a side wall of the cylindrical recess 260, and a cylindrical recess 250 in the flat forward face thereof having a textured surface at the bottom thereof. The portable light 100 wherein: the curved external side surface of the TIR optical element 200 is substantially parabolic; or the narrower rearward surface of the TIR optical element 200 includes a convex parabolic surface; or the curved external side surface of the TIR optical element 200 is substantially parabolic and the narrower rearward surface of the TIR optical element 200 includes a convex parabolic surface or a peaked conical surface having concave sides. The selectable beam modification element 300 includes a plurality of selectable beam modification elements 300, at least one of the plurality of selectable beam modification elements 300 being opaque and at least one of the plurality of selectable beam modification elements 300 being transparent or translucent and being colored. The selectable beam modification element 300 includes a set of a plurality of selectable beam modification elements 300, each of the selectable beam modification elements 300 having an optical property that is different from an optical property of another of the selectable beam modification elements 300.

A portable light 100 may comprise: a light body 120; a light source 140, 176 selectively energizable for producing light; a switch 160, 172 for selectively energizing the light source 140, 176; a TIR optical element 200 disposed in front of the light source 140, 176 for receiving the light produced thereby, and to form the light produced thereby into a collimated beam of light, the TIR optical element having a recess 250 in a forward face thereof; and a selectable beam modification element 300 placeable into and removable from the recess 250 in the forward face of the TIR optical element. The means for removably retaining may include: friction between the selectable beam modification element 300 and the recess 250, pressure urging the selectable beam modification element 300 into the recess 250, a cover, a lens, a lens and ring, a press in cover, a snap in cover, the selectable beam modification element 300 having a resilient periphery, the selectable beam modification element 300 being of a resilient material, the selectable beam modification element 300 having a diameter to contact the inner surface of the recess 250 in the TIR optical element 200, the selectable beam modification element 300 having an O-ring in a peripheral groove, or a combination thereof. The selectable beam modification element 300 may be opaque, or transparent, or translucent, or a color, or a combination thereof. The TIR optical element 200 may comprise: a shaped optically clear plastic element 210 having a polished curved external side surface 240, a generally wider flat forward surface 220, and a narrower rearward shaped surface 230, 260, 270. The TIR optical element 200 may have: a substantially cylindrical recess 260 at the rearward shaped surface thereof, the substantially cylindrical recess 260 having a curved convex bottom or a peaked conical bottom having concave sides for reflecting light through a side wall of the cylindrical recess 260; or a cylindrical recess 250 in the flat forward face thereof having a textured surface at the bottom thereof; or a substantially cylindrical recess 260 at the rearward shaped surface thereof, the substantially cylindrical recess 260 having a curved convex bottom or a peaked conical bottom having concave sides for reflecting light through a side wall of the cylindrical recess 260, and a cylindrical recess 250 in the flat forward face thereof having a textured surface at the bottom thereof. The portable light 100 wherein: the curved external side surface of the TIR optical element 200 is substantially parabolic; or the narrower rearward surface of the TIR optical element 200 includes a convex parabolic surface; or the curved external side surface of the TIR optical element 200 is substantially parabolic and the narrower rearward surface of the TIR optical element 200 includes a convex parabolic surface or a peaked conical surface having concave sides. The selectable beam modification element 300 includes a plurality of selectable beam modification elements 300, at least one of the plurality of selectable beam modification elements 300 being opaque and at least one of the plurality of selectable beam modification elements 300 being transparent or translucent and being colored. The selectable beam modification element 300 includes a set of a plurality of selectable beam modification elements 300, each of the selectable beam modification elements 300 having an optical property that is different from an optical property of another of the selectable beam modification elements 300.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "up," "down," "left," "right," "up," "down," "front," "rear," "side," "end," "top," "bottom," "forward," "backward," "under" and/or "over," "vertical," "horizontal," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

The term battery is used herein to refer to an electrochemical device comprising one or more electro-chemical cells and/or fuel cells, and so a battery may include a single cell or plural cells, whether as individual units or as a packaged unit. A battery is one example of a type of an electrical power source suitable for a portable device. Other devices could include fuel cells, super capacitors, solar cells, and the like. Any of the foregoing may be intended for a single use or for being rechargeable or for both Various embodiments of a battery may have one or more battery cells, e.g., one, two, three, four, or five or more battery cells, as may be deemed suitable for any particular device. A battery may employ various types and kinds of battery chemistry types, e.g., a carbon-zinc, alkaline, lead acid, nickel-cadmium (Ni—Cd), nickel-metal-hydride (NiMH) or lithium-ion (Li-Ion) battery type, of a suitable number of cells and cell capacity for providing a desired operating time and/or lifetime for a particular device, and may be intended for a single use or for being rechargeable or for both. Examples may include a four cell lead acid battery typically producing about 6 volts, volts, a four cell Ni—Cd battery typically producing about 6 volts, a four cell NiMH battery typically producing about 4.8 volts, a four cell NiMH battery producing about 6 volts, or a Li-Ion battery typically producing about the same voltage, it being noted that the voltages produced thereby will be higher when approaching full charge and will be lower in discharge, particularly when providing higher current and when reaching a low level of charge, e.g., becoming discharged.

While the present invention has been described in terms of the foregoing example embodiments, variations within the scope and spirit of the present invention as defined by the claims following will be apparent to those skilled in the art. For example, in optical element 200, side surface 240 may have a parabolic, hyperbolic or spherical shape and curved bottom 270 may have the same or a different parabolic, hyperbolic or spherical shape, or surfaces 240, 270 may have another suitable shape.

Hanger or loop 14*h*, 155 may alternatively be rendered pivotable by the ends thereof being disposed in holes in clip 14*c* or the ends or a portion thereof being directly and pivotably attached to housing 1, 120 by bracket 14*b*.

Each of the U.S. Provisional Applications, U.S. Patent Applications, and/or U.S. Patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A portable light comprising:

a light body for receiving a source of electrical power;

a light source supported by said light body and selectively energizable for producing light;

a switch supported by said light body for selectively energizing said light source from the source of electrical power;

a totally internally reflective (TIR) optical element having a rearward end disposed in front of said light source for receiving the light produced thereby, said TIR optical element employing total internal reflection to form light produced by said light source into a collimated beam of light, said TIR optical element having a recess in a forward face thereof;

a selectable beam modification element having a size and shape corresponding to the recess in the forward face of said TIR optical element, wherein said selectable beam modification element is placeable into the recess in the forward face of the TIR optical element and is removable from the recess in the forward face of the TIR optical element; and means for removably retaining said selectable beam modification element in the recess in the forward face of said TIR optical element.

2. The portable light of claim 1 wherein said means for removably retaining includes: friction between said selectable beam modification element and the recess, pressure urging said selectable beam modification element into the recess, a cover, a lens, a lens and ring, a press in cover, a snap in cover, said selectable beam modification element having a resilient periphery, said selectable beam modification element being of a resilient material, said selectable beam modification element having a diameter to contact the inner surface of the recess in said TIR optical element, said selectable beam modification element having an O-ring in a peripheral groove, or a combination thereof.

3. The portable light of claim 1 wherein said selectable beam modification element is opaque, or transparent, or translucent, or a color, or a combination thereof.

4. The portable light of claim 1 wherein said TIR optical element comprises: a shaped optically clear plastic element having a polished curved external side surface, a generally wider flat forward surface, and a narrower rearward shaped surface.

5. The portable light of claim 4 wherein said TIR optical element has:

a substantially cylindrical recess at the rearward shaped surface thereof, the substantially cylindrical recess having a curved convex bottom or a peaked conical bottom having concave sides for reflecting light through a side wall of the cylindrical recess; or a cylindrical recess in the flat forward face thereof having a textured surface at the bottom thereof; or a substantially cylindrical recess at the rearward shaped surface thereof, the substantially cylindrical recess having a curved convex bottom or a peaked conical bottom having concave sides for reflecting light through a side wall of the cylindrical recess, and a cylindrical recess in the flat forward face thereof having a textured surface at the bottom thereof.

6. The portable light of claim 4 wherein:

the curved external side surface of said TIR optical element is substantially parabolic or is a series of arcs; or the narrower rearward surface of said TIR optical element includes a convex parabolic surface or a peaked conical surface having concave sides; or the curved external side surface of said TIR optical element is substantially parabolic or is a series of arcs and the narrower rearward surface of said TIR optical element includes a convex parabolic surface or a peaked conical surface having concave sides.

7. The portable light of claim 1 wherein said selectable beam modification element includes a plurality of selectable beam modification elements, at least one of the plurality of selectable beam modification elements being opaque and at least one of the plurality of selectable beam modification elements being transparent or translucent and being colored.

8. The portable light of claim 1 wherein said selectable beam modification element includes a set of a plurality of selectable beam modification elements, each of said selectable beam modification elements having an optical property that is different from an optical property of another of said selectable beam modification elements.

9. A portable light comprising:

a light body;

a light source selectively energizable for producing light;

a switch for selectively energizing said light source;

a totally internally reflective (TIR) optical element disposed in front of said light source for receiving the light produced thereby, and to form the light produced thereby into a collimated beam of light, said TIR optical element having a recess in a forward face thereof; and a selectable beam modification element placeable into and removable from the recess in the forward face of the TIR optical element.

10. The portable light of claim 9 wherein said selectable beam modification element includes: friction between said selectable beam modification element and the recess, pressure urging said selectable beam modification element into the recess, a cover, a lens, a lens and ring, a press in cover, a snap in cover, said selectable beam modification element having a resilient periphery, said selectable beam modification element being of a resilient material, said selectable beam modification element having a diameter to contact the inner surface of the recess in said TIR optical element, said selectable beam modification element having an O-ring in a peripheral groove, or a combination thereof.

11. The portable light of claim 9 wherein said selectable beam modification element is opaque, or transparent, or translucent, or a color, or a combination thereof.

12. The portable light of claim 9 wherein said TIR optical element comprises: a shaped optically clear plastic element having a polished curved external side surface, a generally wider flat forward surface, and a narrower rearward shaped surface.

13. The portable light of claim 12 wherein said TIR optical element has:

a substantially cylindrical recess at the rearward shaped surface thereof, the substantially cylindrical recess having a curved convex bottom or a peaked conical bottom having concave sides for reflecting light through a side wall of the cylindrical recess; or a cylindrical recess in the flat forward face thereof having a textured surface at the bottom thereof; or a substantially cylindrical recess at the rearward shaped surface thereof, the substantially cylindrical recess having a curved convex bottom or a peaked conical bottom having concave sides for reflecting light through a side wall of the cylindrical recess, and a cylindrical recess in the flat forward face thereof having a textured surface at the bottom thereof.

14. The portable light of claim 12 wherein:

the curved external side surface of said TIR optical element is substantially parabolic or is a series of arcs; or the narrower rearward surface of said TIR optical element includes a convex parabolic surface; or the curved external side surface of said TIR optical element is substantially parabolic or is a series of arcs and the narrower rearward surface of said TIR optical element includes a convex parabolic surface or a peaked conical surface having concave sides.

15. The portable light of claim 9 wherein said selectable beam modification element includes a plurality of selectable beam modification elements, at least one of the plurality of selectable beam modification elements being opaque and at least one of the plurality of selectable beam modification elements being transparent or translucent and being colored.

16. The portable light of claim 9 wherein said selectable beam modification element includes a set of a plurality of selectable beam modification elements, each of said selectable beam modification elements having an optical property that is different from an optical property of another of said selectable beam modification elements.

17. A portable light comprising:

a light body;

a light source selectively energizable for producing light;

a switch for selectively energizing said light source;

a totally internally reflective (TIR) optical element having a rearward end disposed in front of said light source for receiving the light produced thereby, said TIR optical element being an optically clear plastic element having a polished curved external side surface, a generally wider flat forward surface having a recess therein, and a narrower rearward shaped surface and employing total internal reflection to form light produced by said light source into a collimated beam of light;

a selectable beam modification element having a size and shape corresponding to the size and shape of the recess in the forward face of said TIR optical element, wherein said selectable beam modification element is placeable into the recess in the forward face of the TIR optical element and is removable from the recess in the forward face of the TIR optical element; and wherein said selectable beam modification element is configured to be retained in the recess in the forward face of said TIR optical element by: friction between said selectable beam modification element and the recess, pressure urging said selectable beam modification element into the recess, a cover, a lens, a lens and ring, a press in cover, a snap in cover, a resilient periphery of said selectable beam modification element, said selectable beam modification element being of a resilient material, said selectable beam modification element having a diameter to contact the inner surface of the recess in said TIR optical element, said selectable beam modification element having an O-ring in a peripheral groove, or a combination thereof.

18. The portable light of claim 17 wherein said TIR optical element has:

a substantially cylindrical recess at the rearward shaped surface thereof, the substantially cylindrical recess having a curved convex bottom or a peaked conical bottom having concave sides for reflecting light through a side wall of the cylindrical recess; or a cylindrical recess in the flat forward face thereof having a textured surface at the bottom thereof; or a substantially cylindrical recess at the rearward shaped surface thereof, the substantially cylindrical recess having a curved convex bottom or a peaked conical bottom having concave sides for reflecting light through a side wall of the cylindrical recess, and a cylindrical recess in the flat forward face thereof having a textured surface at the bottom thereof.

19. The portable light of claim 17 wherein said selectable beam modification element is opaque, or transparent, or translucent, or a color, or a combination thereof.

* * * * *